United States Patent [19]

Kubo et al.

[11] Patent Number: 5,062,284

[45] Date of Patent: Nov. 5, 1991

[54] METHOD OF FABRICATING A BENT METAL BODY WITH HARDENABLE RESIN COATING

[75] Inventors: Masao Kubo, Koshigaya; Tetsuo Miyake, Saitama; Kunimitsu Matsuzaki, Yono; Katsuji Kitagawa, Kasukabe, all of Japan

[73] Assignee: Somar Corporation, Japan

[21] Appl. No.: 611,759

[22] Filed: Nov. 7, 1990

[30] Foreign Application Priority Data

Nov. 10, 1989 [JP] Japan ..... 1-293105

[51] Int. Cl.[5] ..... B21B 45/00

[52] U.S. Cl. ..... 72/46; 427/388.1

[58] Field of Search ..... 72/46, 379.4, 379.2; 427/386, 388.1, 388.2

[56] References Cited

U.S. PATENT DOCUMENTS

| | | | |
|---|---|---|---|
| 3,206,848 | 9/1965 | Rentmeester | 72/46 |
| 4,032,678 | 6/1977 | Perfetti et al. | 427/388.2 |
| 4,505,981 | 3/1985 | Geist | 427/388.1 |
| 4,621,399 | 11/1986 | Qureshi et al. | 72/46 |

FOREIGN PATENT DOCUMENTS

| | | | |
|---|---|---|---|
| 3832470 | 4/1989 | Fed. Rep. of Germany | 427/388.1 |
| 0220729 | 12/1983 | Japan | 427/388.1 |
| 2219543 | 12/1989 | United Kingdom | 72/46 |
| 8202349 | 7/1982 | World Int. Prop. O. | 72/46 |

*Primary Examiner*—Lowell A. Larson
*Assistant Examiner*—Michael J. McKeon
*Attorney, Agent, or Firm*—Lorusso & Loud

[57] ABSTRACT

A bent metal body with a resin coating is fabricated by first applying a powder coating composition to a metal body to form a hardenable resin layer, then bending the metal body bearing the resin layer, and then hardening the hardenable resin layer to form the resin coating.

5 Claims, No Drawings

METHOD OF FABRICATING A BENT METAL BODY WITH HARDENABLE RESIN COATING

BACKGROUND OF THE INVENTION

This invention relates to a method for the fabrication of a bent metal body having a resin layer coated on at least the bent portion thereof.

It is known from the past to form a resin layer over a surface of a metal body, such as a straight pipe, by a fluidized powder coating method in which a metal body preheated to a temperature sufficient to cause melting and hardening of the resin contained in a powder coating composition is immersed in and brought into contact with a fluidized mass of the powder coating composition to form a hardened coating of the resin. In this case, the metal body to be coated is maintained in a vertical position. When the powder coating composition is of an expansion type, the contact of the heated metal body with the fluidized mass of the powder coating composition can form an expanded or foamed layer of the resin over the surface of the metal body.

When such a coating method is applied to a bent metal body, such as an L-shaped pipe, the fluidized particles tend to accumulate on an upper side of a horizontally extending portion of the body so that the resulting resin coating becomes extraordinary thick in that portion.

SUMMARY OF THE INVENTION

The present invention has been made with the above problem of the conventional techniques in view and provides an improved method of processing a metal body to fabricate a bent metal body having a hardened or expanded resin layer formed on the bent surface thereof.

In accordance with one aspect of the present invention, there is provided a method of processing a metal body to produce a bent, metal body having a hardened resin coating on at least the bent surface, comprising the steps of:

(a) providing a powder coating composition providing a flexible, hardenable coating;

(b) coating a surface of the metal body with the powder coating composition at a temperature sufficient to melt the coating composition while preventing the coating composition from hardening, thereby to form a flexible, hardenable layer over the surface of the metal body;

(d) then bending the metal body at a portion having the hardenable layer; and (e) then subjecting the hardenable layer to a hardening condition to harden the hardenable layer.

The metal body may be in the form of, for example, a pipe, a rod or a plate. The bent body may be, for example, a U-shaped or an L-shaped body.

The present invention will now be described in detail below.

DESCRIPTION OF THE PREFERRED EMBODIMENTS

Various powder coating composition may be used for the purpose of the present invention as long as they can provide a flexible, hardenable or expandable coating. The powder coating composition generally contains a flexible resin or a rubber. Illustrative of suitable flexible resins are urethan-modified bisphenol A epoxy resins (disclosed, for example, in Japanese patent publication No. 56-5456), glycol-modified bisphenol epoxy resins, ethylene/vinyl acetate copolymers, partially saponified ethylene/vinyl acetate copolymers, butyral resins, polyvinyl alcohols, saturated polyester resins, poly(meth)acrylic acid resins, copolymers of poly(meth)acrylic resins, polyamide resins and polyamideamine resins. Illustrative of suitable rubber are natural rubber, diene-type rubber and nondiene-type rubber. Examples of suitable powder coating compositions are described below.

(A) Epoxy Resin Powder Coating Composition:

Epoxy resin composition containing an epoxy resin, a latent curing agent and a filler is generally used. To impart flexibility, the following three methods may be adopted. In the first method, a flexible epoxy resin is used as at least part of the epoxy resin. The content of the flexible epoxy resin is generally 10–80% by weight, preferably 30–60% by weight, based on the total amount of the epoxy resins used. In the second method, a flexible curing agent such as long chain dicarboxylic acids or modified products thereof is used as at least part of the curing agent. The flexible curing agent is generally used in an amount of at least 10 parts by weight per 100 parts by weight of the epoxy resin. In the third method, a rubber or a thermoplastic resin, preferably carboxylic acid-terminated or hydroxyl group-terminated thermoplastic resin, is incorporated into the coating composition in an amount of 10–60 parts by weight, preferably 30–50 parts by weight per 100 parts by weight of the epoxy resin. By applying the above epoxy resin powder coating composition to a metal substrate at a temperature sufficient to melt the coating composition but insufficient to harden the coating composition, there may be formed a hardenable coating. After bending the coated metal substrate, the coating is heated to complete hardening.

(B) Cyanate-Containing Powder Coating Composition:

Powder coating compositions are known which contain a cyanate and bismaleimide (Japanese patent publications Nos. 52-31279, 54-30440 and 62-57420). By incorporating a flexibility imparting component into such compositions, there are obtainable powder coating compositions suitable for use in the present invention. The flexibility imparting component may be, for example, a flexible epoxy resin, a diene-type rubber, polybutadiene, polyethyleneglycol diacrylate or polybutyl butyral.

Especially preferred is the use of a powder coating composition which includes:

a functional thermoplastic resin capable of reacting with a cyanate group and having a molecular weight of at least 10,000;

a polyfunctional cyanate compound; and a viscosity controlling agent which is a compound having at least one functional group capable of reacting with said functional thermoplastic resin and/or said polyfunctional cyanate compound and a molecular weight of less than 10,000.

This composition will be described in detail below.

The functional thermoplastic resin to be used in the present invention should contain one or more functional groups capable of reacting with a cyanate group. Examples of such functional groups include an alcoholic or phenolic hydroxyl group, a carboxylic group, an amino group and an amide group. Illustrative of suitable functional thermoplastic resins are partially saponified polyvinyl acetates, polyvinyl alcohols, partially saponified ethylene/vinyl acetate copolymers, butylal resins, polyacrylic acid, copolymers of acrylic acid, polymethacrylic acid, copolymers of methacrylic acid, saturated polyester resins, polyamide resins and polyamideamine resins.

For reasons of improved bonding of a coated layer to a metal substrate, it is preferred that the functional thermoplastic resin contain both hydroxyl and carboxyl groups. Such a polymer containing both hydroxyl and carboxyl groups can be obtained by, for example, conducting the polymerization for the production of a hydroxyl group-containing polymer, such as a butylal resin or a partially saponified ethylene/vinyl acetate copolymer, in the presence of a copolymerizable unsaturated carboxylic acid, such as maleic anhydride, acrylic acid, methacrylic acid or itaconic acid. Alternatively, grafting of such an unsaturated carboxylic acid onto a hydroxyl group-containing polymer can give a polymer containing both hydroxyl and carboxyl groups.

The thermoplastic resin may be used in combination with an adjuvant resin, such as a polyolefin, an ethylene/vinyl acetate copolymer, a polyvinyl chloride, an ethylene/ethyl acrylate copolymer or an epoxy resin, which does not react with a cyanate compound. Examples of suitable polyolefins include polyethylenes, ethylene/propylene copolymers, polypropylenes and polybutene-1. When such an adjuvant resin is used, the amount of the functional thermoplastic resin is generally 50% by weight or more, preferably 60% by weight or more based on the total weight of the functional thermoplastic resin and the adjuvant resin.

The polyfunctional cyanate compound to be used in the present invention is an organic compound having two or more cyanate groups and includes a monomer having two or more cyanate groups, a prepolymer thereof, and a prepolymer thereof with an amine. As the monomer there may be preferably used a compound of the general formula: $Ar(OCN)_m$ wherein Ar is an aromatic group and m is an integer of 2–5, or a prepolymer thereof.

Examples of the monomeric polyfunctional cyanate compounds having the above general formula include benzene dicyanate, benzene tricyanate, naphthalene dicyanate, 4,4'-dicyanatobiphenyl, bis(4-cyanatophenyl)methane, 2,2-bis(4-cyanatophenyl)propane, 2,2-bis(3,5-dichloro-4-cyanatophenyl)propane, bis(4-cyanatophenyl)ether, bis(4-cyanatophenyl)sulfone, tris(4-cyanatophenyl)phosphite, tris(4-cyanatophenyl)-phosphate, and cyanic acid esters obtained by reaction of a novolak resin with a halogenated cyan compound.

Prepolymers of the above monomeric polyfunctional cyanate compounds may be obtained by polymerizing the monomers in the presence of a catalyst such as a mineral acid or a Lewis acid. The resulting prepolymers generally contain triazine rings. Prepolymers of the above monomeric polyfunctional cyanate compounds with an amine may be obtained by reaction between them. As the amine, there may be used phenylenediamine, xylylenediamine, diaminobiphenyl and bis-(aminophenyl)propane.

The amount of the polyfunctional cyanate compound is generally 10–100 parts by weight, preferably 30–80 parts by weight per 100 parts by weight of the functional thermoplastic resin.

It is preferred that the polyfunctional cyanate compound be used in combination with a polyfunctional maleimide compound for reasons of improved thermal resistance of cured products. The maleimide compound is an organic compound having two or more N-maleimide groups and includes a monomer having two or more N-maleimide groups, a prepolymer thereof, and a prepolymer thereof with an amine. As the monomer there may be preferably used a compound of the general formula (I):

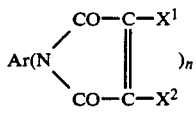

(I)

wherein Ar is an aromatic or alicyclic group, $X^1$ and $X^2$ are, independently from each other, hydrogen, a halogen or an alkyl and n is an integer of 1–5.

The monomeric maleimide compound of the above formula may be obtained by a conventional method wherein a maleic anhydride compound is reacted with a polyamino compound to form a maleamide acid, the resulting maleamide acid being subjected to dehydrative cyclization. The polyamino compound may be, for example, phenylenediamine, xylylenediamine, cyclohexanediamine, 4,4'-diaminobiphenyl, bis(4-aminophenyl)methane, bis(4-aminophenyl)ether, bis(4-amino-3-methylphenyl)methane, 2,2-bis(4-aminophenyl)propane, 2,2-bis(4-amino-3-methylphenyl)propane, 2,2-bis(4-amino-3-chlorophenyl)propane or 1,1-bis(4-aminophenyl)-1-phenylethane.

Prepolymers of the above monomeric polyfunctional maleimide compounds may be obtained by heating the monomers in the presence of a catalyst such as an organic acid salt or a peroxide. Prepolymers of the above monomeric polyfunctional maleimide compounds with an amine may be obtained by reaction between them. As the amine, there may be used the above polyamino compounds.

When the polyfunctional cyanate compound is used in combination with the polyfunctional maleimide compound, they may be used in the form of a mere mixture or in the form of a reaction product (so called "B-stage" resin). Such a B-stage resin may be obtained by reacting the both compounds preferably in the presence of a suitable catalyst such as an organometal salt or a tertiary amine.

The amount of the polyfunctional maleimide compound is generally up to 40%, preferably 10–30% based on the total weight of the polyfunctional cyanate compound and the polyfunctional maleimide compound. The total amount of the polyfunctional cyanate compound and the polyfunctional maleimide compound is generally 20–120 parts by weight, preferably 40–90 parts by weight per 100 parts by weight of the functional thermoplastic resin.

The viscosity controlling agent is a compound having a molecular weight of less than 10,000, preferably 150–5,000 and one or more functional groups capable of reacting with the polyfunctional cyanate compound and/or the functional thermoplastic resin when heated at a temperature sufficient to melt a mixture of the functional thermoplastic resin, the polyfunctional cyanate compound and the viscosity controlling agent, generally at a temperature of 120° C. or higher. Preferably, the viscosity controlling agent to be employed in the present invention is a solid or paste at room temperature and has a softening point or melting point of 100° C. or less. However, a liquid, viscosity controlling agent may be used as long as the resulting composition can be in the form of powder.

Examples of the viscosity controlling agent include a polyol compound, a polyamine compound, an amide compound, a fatty amine or a salt thereof, a polyfunctional methacrylate, a polyfunctional acrylate, an acrylate modified with caprolactone and a methacrylate modified with caprolactone. An oligomer of the above-described functional thermoplastic resin may also be used.

The polyol compound is preferably (a) an ether-containing diols having the following general formula (II):

$$HO\text{-}(C_mH_{2m}O)_nH \qquad (II)$$

wherein m is a positive integer, preferably 2–6 and n is an integer of at least 2, preferably 10–150, (b) an ester-containing diols having the following general formula (III):

$$HO\text{-}(CH_2)_r\text{-}CO]_qR\ O\text{-}CO\text{-}(CH_2)_r]_qOH \qquad (III)$$

wherein R stands for an alkylene having 2–10 carbon atoms, r is an integer of 1 or more, preferably 3–7, and q is an integer of 1 or more, preferably 3–40, or (c) a saturated hydrocarbon having 1.5–3 terminal hydroxyl groups and a molecular weight of 1000–5000. These polyol compounds can react with the above polyfunctional cyanate compound and with thermoplastic resins having amino or carboxyl groups.

The polyamine compound is preferably a diamine having the formula (IV):

$$H_2NC_3H_6O\ C_2H_4O\ {}_nC_3H_6NH_2 \qquad (IV)$$

wherein n is an integer of 20–150. These polyamines can react with the above polyfunctional cyanate compound and with thermoplastic resins having amino or carboxyl groups.

The amide compound to be used as the viscosity controlling agent is preferably a fatty amide such as stearylamine acetate. Amides containing ethylenically unsaturated groups such as diacetone acrylamide of the formula: $CH_2{=}CHCONHC(CH_3)_2CH_2COCH_3$ may be also suitably used. Such an unsaturated group-containing amide can react with the above polyfunctional cyanate compounds and is polymerizable per se and copolymerizable with the above maleimide compounds.

The fatty amine to be used as the viscosity controlling agent may be tallow amine, stearylamine or distearylamine.

The viscosity controlling agent serves to lower the viscosity of a melt of the powder composition and to facilitate the deposition thereof to a solid surface to be coated. When the powder composition is used for the production of molded articles, the viscosity controlling agent serves to control the melt index thereof within a suitable range. The viscosity controlling agent is preferably used in an amount so that the powder composition shows a horizontal melt flow of 5–40%. The term "horizontal melt flow" used in the present specification and appended claims is defined by the following equation:

$$MF = \frac{d - 16}{16} \times 100\ (\%)$$

wherein MF is the horizontal melt flow and d is a diameter of a melt of the sample composition (1 g) formed into a tablet having a diameter of 16 mm and heated on a horizontal, flat, soft steel plate at 140° C. When the melt flow is smaller than 5%, there is a danger of causing pin holes in the resulting coating. On the other hand, a melt flow of greater than 40% tends to cause the formation of "icicles". The amount of said viscosity controlling agent varies with the kind thereof and is generally 5–100 parts by weight per 100 parts by weight of the functional thermoplastic resin. Specifically, the amount is preferably 20–60 parts by weight per 100 parts by weight of the thermoplastic resin when a polyol compound is used. In the case of a polyamine compound, the amount is preferably 5–30 parts by weight.

The powder composition of the present invention may further contain a crosslinking agent such as a polyisocyanate compound, an organic peroxide or a mixture thereof.

The polyisocyanate compound is a compound having two or more isocyanate group and is preferably a solid at room temperature. Illustrative of suitable isocyanate compounds are phenylenediisocyanate, tolylenediisocyante, biphenylenediisocyanate and diphenylmethane-p,p-diisocyanate. Blocked polyisocyante compounds having their isocyanate groups blocked with an active hydrogen-containing compound such as an amide, a lactam, phenol, an alcohol, an oxyme or a mercaptane can also be suitably used for the purpose of the present invention. -Caprolactam is a particularly preferred active hydrogen-containing compound. For example, a compound having the formula (V):

(V)

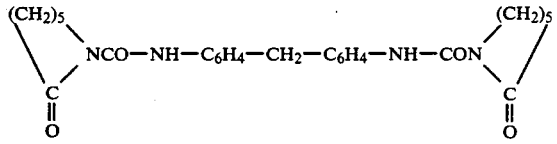

may be suitably used as the cross-linking agent.

The polyisocyante compound or its blocked derivative can react with the functional groups of the functional thermoplastic resin to cross-link same. It can also react with the viscosity controlling agent to form high molecular weight compounds. The polyisocyanate compound is used in an amount providing a ratio (NCO/OH) of equivalents of the isocyanate group per equivalent of the functional group in the composition of less than 1, preferably 0.03–0.8.

The organic may be, for example, dicumyl peroxide, bis(t-butylperoxy)isopropylbenzene, dimethyldi(t-butylperoxy)hexane or dimethyldi(t-butylperoxy)hexyne. The organic peroxide can react with tertiary hydrogen of the resin to form crosslinkages. The amount of the organic peroxide is generally 0.5–7.0 parts by weight, preferably 1.0–4.0 parts by weight per 100 parts by weight of the thermoplastic resin.

Various additives may be incorporated into the powder composition according to the present invention. For example, a catalyst such as organic base, a phenol compound, an organometallic salt, inorganic metal salt or acid anhydride may be used for facilitating the reaction between a polyfunctional cyanate compound a polyfunctional maleimide compound. An organic or inorganic filler may be used for controlling the viscosity of a melt of the composition and the strength of coatings or shaped bodies obtained from the composition. When the composition is to be cured by irradiation of UV rays, a photosensitizer may be incorporated into the composition. A colorant, a thixotropy-imparting agent or oxidation-preventing agent may also be added as desired.

The powder coating composition according to the present invention may be obtained by mixing and kneading the above components with each other at a temperature higher than the melting point of the resin, pelleticizing the kneaded mixture, and grinding the pellets. The mixing step is desirably carried out at a temperature lower than the temperature at which the cross-linking occurs so that the occurrence of cross-linking is substantially prevented. Further, it is advantageous to carry out the grinding step while cooling the pellets with, for example, liquid nitrogen to a temperature lower than the brittle temperature of the resin.

The powder coating composition preferably has such a particle size distribution that the content of particles with a particle size of 30 mesh (Tyler) or finer is 100% by weight, the content of particles with a particle size of 200 mesh or finer is at least 50% by weight and the content of particles with a particle size of 325 mesh or finer is not greater than 50% by weight, for the purpose of facilitating the deposition of the coating composition onto a substrate during the powder coating stage.

By applying the above cyanate-containing powder coating composition to a metal substrate at a temperature sufficient to melt the coating composition but insufficient to harden the coating composition, there may be formed a hardenable coating. After bending the coated metal substrate, the coating is heated to complete hardening. The hardening may also be effected by irradiation of actinic light such as UV rays and ionized radiation.

(C) Expandable Powder Coating Composition:

Expandable powder coating compositions may be obtained by incorporating a heat decomposition type blowing agent into the above-described hardenable powder coating compositions. In an alternative, an expandable powder coating composition may be provided by a combination of a thermoplastic resin, a crosslinking agent and a heat decomposition type blowing agent.

One preferred expandable powder coating composition suitable for use in the present invention includes:

(a) a thermoplastic resin containing a hydroxyl group-containing polymer;

(b) a cross-linking agent containing a polyisocyanate compound which is capable of reacting with the hydroxyl groups of said polymer at a temperature higher than the melting point of said thermoplastic resin to crosslink said polymer and which is solid at room temperature; and (c) a blowing agent capable of decomposing and generating a gas when heated to a temperature higher than the melting point of said thermoplastic resin.

The thermoplastic resin which serves, upon expansion, as a structural material is a hydroxyl group-containing polymer or a mixed polymer containing same. Examples of suitable hydroxyl group-containing polymer include polyvinyl alcohols, partially or entirely saponified ethylene/vinyl acetate copolymers, polyvinyl butyral resins, hydroxyl-terminated polyester resins and bisphenol type epoxy resins. Such polymers preferably have a weight average molecular weight of about 10,000–100,000, more preferably about 35,000–80,000.

For the purpose of improving bonding of a foamed layer obtained from the coating composition to a substrate, it is preferred that the hydroxyl group-containing polymer further contain carboxyl groups. Such a polymer containing both hydroxyl and carboxyl groups can be obtained by conducting the polymerization for the production of the above hydroxyl group-containing polymer in the presence of an unsaturated carboxylic acid, such as maleic anhydride, acrylic acid, methacrylic acid or itaconic acid. Alternatively, grafting of such an unsaturated carboxylic acid onto the above hydroxyl group-containing polymer can give a polymer containing both hydroxyl and carboxyl groups.

The thermoplastic resin may further contain a hydroxyl group-free polymer such as a polyolefin, an ethylene/vinyl acetate copolymer, a polyvinyl chloride or an ethylene/ethyl acrylate copolymer. Examples of suitable polyolefins include polyethylenes, ethylene/propylene copolymers, polypropylenes and polybutene-1. When such a hydroxyl group-free polymer is used, the amount of the hydroxyl group-containing polymer in the thermoplastic resin is generally 50% by weight or more, preferably 60% by weight or more.

The thermoplastic resin is preferably used in conjunction with a viscosity controlling agent which can control the viscosity of the coating composition in a molten state to facilitate the expansion thereof. A polyol compound which is solid or semi-solid at room temperature is preferably used as the viscosity controlling agent.

Illustrative of suitable polyol compounds are the compounds represented by the above general formulas (II) and (III) and polymers having a saturated hydrocarbon skeleton and a molecular weight of 1000–5000 and containing 1.5–3 terminal hydroxyl groups. The polyol compound is used in an amount of 5–100 parts by weight, preferably 20–60 parts by weight per 100 parts by weight of the thermoplastic resin. The molecular weight of the polyol compound is generally about 300–6,000, preferably about 2,000–5,000.

Any polyisocyante compound which is solid at room temperature and which has two or more isocyante groups may be used as the cross-linking agent in the coating composition of the present invention. Examples of the polyisocyanate compounds include phenylenediisocyanate, tolylenediisocyanate, biphenylenediisocyanate and diphenylmethane-p,p-diisocyanate. Blocked polyisocyanate compounds having their isocyanate groups blocked with an active hydrogen-containing compound such as an amide, a lactam, phenol, an alcohol, an oxyme or a mercaptane can also be suitably used for the purpose of the present invention. -Caprolactam is a particularly preferred active hydrogen-containing compound. For example, the compound of the formula (V) may be suitably used as the cross-linking agent.

The polyisocyante compound or its blocked derivative can react with the hydroxyl groups of the hydroxyl group-containing polymer to cross-link same. It can also react with the polyol compound which is optionally contained in the coating composition to form high molecular weight compounds. The polyisocyanate compound is used in an amount providing a ratio (NCO/OH) of equivalents of the isocyanate group per equivalent of the hydroxyl group in the composition of less than 1, preferably 0.03–0.8.

The cross-linking agent may further contain an organic peroxide in an amount of 0.5–7.0 parts by weight, preferably 1.0–4.0 parts by weight per 100 parts by weight of the thermoplastic resin. The organic peroxide may be, for example, dicumyl peroxide, bis(t-butylperoxy)isopropylbenzene, dimethyldi(t-butylperoxy)-hexane or dimethyldi(t-butylperoxy)hexyne.

The blowing agent may be an organic one such as azodicarbonamide, 2,2'-azobisisobutyronitrile, dinitrosopentamethylenetetramine, 4,4'-oxybisbenzene-sulfonyl hydrazide or paratoluenesulfonyl hydrazide, or an inorganic one such as sodium bicarbonate, ammonium carbonate, sodium borohydride or silicon oxyhydride. These blowing agents may be used by themselves or as a mixture of two or more. When the blowing agent used has a high decomposition temperature, the use of an expansion aid such as zinc oxide is effective in lowering the decomposition temperature. In the coating composition of the present invention, it is desirable to use several kinds of crosslinking agents together with an expansion aid for reasons of broadening the temperature range in which the composition is able to be expanded and of permitting the expansion to proceed uniformly even when the temperature at which the expansion is performed fluctuates.

Another preferred expandable powder coating composition to be used in the present invention includes:

(a) a thermoplastic resin containing a copolymer of ethylene with vinyl acetate;

(b) a cross-linking agent containing an organic peroxide which is capable of reacting with said copolymer at a temperature higher than the melting point of said thermoplastic resin to crosslink said copolymer and which is solid at room temperature;

(c) a blowing agent capable of decomposing and generating a gas when heated to a temperature higher than the melting point of said thermoplastic resin; and (d) an organic plasticizer. This composition will be described in detail below.

The thermoplastic resin which serves, upon expansion, as a structural material is a copolymer of ethylene with vinyl acetate or a polymer mixture containing the copolymer as a major component.

The ethylene/vinyl acetate copolymer preferably has a vinyl acetate content of 5–50% by weight, more preferably 15–35% by weight. The melt index (MI) of the copolymer is preferably 0.5–500 g/10 minutes, more preferably 2–100 g/10 minutes. The thermoplastic resin should contain the copolymer in an amount of at least 50% by weight, preferably at least 60% by weight.

If desired, the copolymer may be used in conjunction with one or more auxiliary polymers such as polyvinyl alcohols, partially saponified ethylene/vinyl acetate copolymers, butyral resins, polyolefins (e.g. polyethylenes, ethylene/propylene copolymers, polypropylenes and polybutene-1), polyvinyl chlorides, ethylene/ethyl acrylate copolymers. Of these, the use of an auxiliary polymer having carboxylic acid groups is desirable, since the resulting composition can give a coating having good bonding to the substrate. Such a carboxylic acid group-bearing polymer may be obtained by incorporating a polymerizable, unsaturated carboxylic acid (e.g. maleic anhydride, acrylic acid, methacrylic acid or itaconic acid) into a reaction mixture for the polymerization of the above-described auxiliary polymers so as to copolymerize the unsaturated carboxylic acid. Alternatively, such a carboxylic acid group-bearing auxiliary polymer may be obtained by grafting an unsaturated carboxylic acid on a hydroxyl group-containing polymer such as polyvinyl alcohol or a butyral resin.

An organic peroxide is used as a curing agent for the above thermoplastic resin. Any organic peroxide may be used as long as it can react with the aliphatic unsaturated bonds of the ethylene/vinyl acetate copolymer to cross-link the copolymer. Examples of suitable organic peroxide include dicumyl peroxide, bis(t-butylperoxy)isopropylbenzene, dimethyl-di(t-butylperoxy)hexane and dimethyldi(t-butylperoxy)hexyne. The organic peroxide is generally used in an amount of 0.5–7.0 parts by weight, preferably 1.0–4.0 parts by weight per 100 parts by weight of the thermoplastic resin.

The blowing agent to be used in the powder coating composition is of a heat-decomposition type and may be organic or inorganic one as described previously. These blowing agents may be used by themselves or as a mixture of two or more. When the blowing agent used has a high decomposition temperature, the use of an expansion aid such as zinc oxide is effective in lowering the decomposition temperature.

The above-described two types of coating composition may further contain various additives such as a filler, a plasticizer, a coloring agent, a free flow improving agent and an antioxidant.

As the fillers, both organic and inorganic ones may be used. The viscosity of the coating composition in a molten state, and the diameter of cells and the mechanical strength of an expanded body obtained from the coating composition may be controlled by controlling the amount and the particle size of the filler to be added.

Illustrative of suitable plasticizers are chlorinated paraffins, dioctylphthalate, diethylene glycol dibenzoate and dicyclohexylphthalate. Other customarily employed plasticizers may also be used. These plasticizers can impart desired cushioning property (elasticity) and flexibility to the coatings obtained from the coating composition.

A plasticizer is incorporated into the powder coating composition for the purpose of controlling the hardness and cushioning properties of a foamed body obtained therefrom. Both liquid and solid plasticizers may be suitably used. The solid plasticizer to be used in the present invention generally has a melting point of 30°–100° C., preferably 30°–60° C., while the liquid plasticizer generally has a viscosity of 30 cP at 25° C.

Illustrative of suitable plasticizers are esters of aromatic carboxylic acids such as dioctyl phthalate, dibutyl phthalate, diheptyl phthalate, diisononyl phthalate and tri-2-ethylhexyl trimellitate; aliphatic diesters such as di-2-ethylhexyl adipate, di-2-ethylhexanoic acid ester of polyethylene glycol and diisobutyric acid ester of 2,2,4-trimethyl-1,3-diol; and phosphates such as triphenyl phosphate and tributoxyethyl phosphate. Plasticizers having aromatic groups such as dioctyl phthalate and triphenyl phosphate are particularly preferably used for the purpose of the present invention. The plasticizer is generally used in an amount of 5–50 parts by weight per 100 parts by weight of the thermoplastic resin. The preferred amount of the plasticizer is 10–40 parts by weight in the case of a solid plasticizer and 10–30 parts by weight in the case of a liquid plasticizer per 100 parts by weight of the thermoplastic resin.

As the filler, both organic and inorganic ones may be used. Illustrative of suitable fillers are zirconium, talc, quartz glass, calcium carbonate, magnesium oxide, calcium silicate, silica, aluminum hydroxide, magnesium hydroxide and phenol resin. The particle size of the filler is generally about 104 μm or less (150 mesh (Tyler) or finer), preferably about 0.1–74 μm. The filler is generally used in an amount of 10–100 parts by weight, preferably 20–50 parts by weight per 100 parts by weight of the thermoplastic resin. By controlling the amount and the particle size of the filler, the viscosity of the coating composition in a molten state, and the diameter of cells and the mechanical strength of an expanded body obtained from the coating composition may be controlled.

The expandable powder coating composition may be obtained by mixing and kneading the above components with each other at a temperature higher than the melting point of the resin, pelleticizing the kneaded mixture, and grinding the pellets. In order to prevent the occurrence of expansion during the mixing stage, a mixing temperature of less than the decomposition temperature of the blowing agent is adopted. Further, the mixing is desired to be carried out at a temperature lower than the temperature at which the cross-linking occurs so that the occurrence of cross-linking is substantially prevented. The grinding of the pellets is generally performed at a temperature of less than 10° C., preferably between −100° and −20° C.

By applying the above expandable powder coating composition to a metal substrate at a temperature sufficient to melt the coating composition but insufficient to expand the coating composition, there may be formed an expandable coating. After bending the coated metal substrate, the coating is heated to effect expansion.

The hardenable and/or expandable powder coating composition to be used in the present invention is not limited to those illustrated in (A)–(C) above. Other powder coating compositions may be used as long as they can provide a hardenable and/or expandable coating having suitable flexibility. The powder coating composition to be used in the present invention should preferably be so selected that the hardenable or expandable coating obtained therefrom has an elongation (in accordance with Japanese Industrial Standards JIS K 6301) of at least 40%. Since the hardenable and/or expandable coating prior to curing and/or expansion is more flexible than the hardened and/or expanded layer thereof, a powder coating composition which affords a hardened and/or expanded layer having an elongation (in accordance with Japanese Industrial Standards JIS K 6301) of at least 20% may be generally used for the purpose of the present invention.

The metal body to be processed by the method of the present invention may be a pipe, a plate, a rod or other molded body formed, for example, of iron, aluminum, copper or other metals or alloys such as stainless steel and brass. A substantially straight or flat body is generally used as a raw material in the present invention, though a slightly curved or warped body may also be used.

The coating of a metal body with a powder coating composition may be carried out in a manner known per se such as by an electrostatic coating method, an electrostatic fluidized bed method or a fluidized bed method. In the fluidized bed method, which is particularly preferable because of its simplicity of apparatus used to carrying out the method and of process steps involved, a metal body is preheated and immersed in a fluidized mass of the powder coating composition to form a melt layer of the coating composition over the surface of the metal body. The surface of the metal body should be maintained at a temperature so that the powder coating composition is melted but is substantially prevented from expanding or hardening. The coated layer is then cooled for solidification. When the solidified coating is not smooth, it may be again heated to re-melt the coating. In the case of an electrostatic coating method, a metal body is first electrostatically applied with a coating of a powder coating composition and the coating is then heated to a temperature sufficient to melt the coating but insufficient to cause hardening or expansion. The resulting melted layer is cooled and solified.

The thus obtained metal body bearing a hardenable and/or expandable resin coating of a thickness of generally 50–5,000 μm, preferably 200–2,500 μm is then bent into a desired shape using any suitable machine such as a bender. Since the resin coating is flexible and has satisfactory elongation, the resin coating may be deformed together with the metal body without causing cracks or other surface defects.

The bent metal body is subsequently subjected to hardening and/or expansion conditions to harden and/or expand the resin coating. The hardening treatment may be effected by heating the coating at a temperature sufficient to cure the hardenable coating. The expansion treatment is effected by heating the coating at a temperature sufficient to decompose the blowing agent. As a result of this treatment, there is obtained a bent, metal body having a hardened and/or foamed resin layer over at least the surface of the bent portion.

In the method of the present invention, it is important that the hardenable and expandable layers should be formed on a metal body before the bending thereof, since otherwise there is caused non-uniformity of the thickness of the coatings. It is also important that the hardening and expansion treatments should be preceded by the bending step. While the bending of the metal body bearing the hardenable or expandable layer causes an increase of thickness of the layer on the inner side of the bent body (due to compression) and an decrease of thickness on the outer side (due to expansion), uniformity is restored to the satisfactory extent during the hardening or expanding treatment which causes melting of the coating.

The following examples will further illustrate the present invention. In the examples, parts are by weight. Elongation and gellation time are measured in accordance with Japanese Industrial Standards JIS K-6301 and JIS C-2104, respectively.

EXAMPLE 1

The following powder coating compositions Nos. 1–6 were used:

Composition 1:

Epoxy resin powder coating composition (EPIFORM F203, manufactured by Somar Corporation), Melting point: 150°–180° C., Curing temperature: over 200° C., Gellation time: 70 seconds, Elongation of unhardened coating: 3.5%, Elongation of hardened coating: 2.5%.

Composition 2:

Epoxy polyester powder coating composition (EPIFORM EPX-6615, manufactured by Somar Corporation), Melting point: 140°–170° C., Curing temperature: over 180° C., Gellation time: 40 seconds, Elongation of unhardened coating: 22%, Elongation of hardened coating: 20%.

Composition 3:

Polyester expoxy coating composition (EPIFORM F-6192, manufactured by Somar Corporation), Melting point: 160°–180° C., Curing temperature: over 200° C., Gellation time: 50 seconds, Elongation of unhardened coating: 28%, Elongation of hardened coating: 25%.

Composition 4:

Triazine-polyolefin powder coating composition (EPX-6659, manufactured by Somar Corporation), Melting point: 180°-200° C., Curing temperature: over 200° C., Gellation time: 50 seconds, Elongation of unhardened coating: 50%, Elongation of hardened coating: 40%.

Composition 5:

Triazine-polyolefin powder coating composition (EPIFORM EPX-6559-1, (manufactured by Somar Corporation), Melting point: 180°-200° C., Curing temperature: over 200° C., Gellation time: 60 seconds, Elongation of unhardened coating: 73%, Elongation of hardened coating: 60%.

Composition 6:

Polyolefin expandable powder coating composition (EPIFORM EPX-6622, (manufactured by Somar Corporation), Melting point: 120°-150° C., Curing/expansion temperature: 140°-200° C., Elongation of unhardened coating: 150%, Elongation of expanded coating: 135%.

Each of the above coating compositions 1-6 was applied to a straight, copper pipe (length: 300 mm, outer diameter: 8 mm, inside diameter: 6 mm) by a fluidization coating method to form a layer of the powder coating composition over the outer surface thereof. The resulting pipe was heated in an oven at 150° C. for 3 minutes and, thereafter, cooled to room temperature, thereby obtaining an unhardened coating formed over the surface of the pipe. This pipe was then bent through an angle of 90° and heated in an oven at 200° C. for 30 minutes to harden the coating. The surface of the hardened layer was checked for surface defects and the results were as summarized in Table 1 below. The evaluation is on the basis of the following ratings:

A: excellent (free of defects)
B: good (almost no defects)
C: no good (small defects)
D: bad (significant defects)
E: poor (very much defects)

COMPARATIVE EXAMPLE

Using Coating Composition No. 5, Example 1 was repeated in the same manner as described except that the hardening treatment was performed before bending. The results are shown in Table 1 below.

TABLE 1

| Powder Coating Composition | Surface Defects of Hardened Coating | | |
|---|---|---|---|
| | Crack | Depression | Thickening of Coating in Inwardly Bent Portion |
| 1 | E | — | — |
| 2 | D | E | E |
| 3 | C | C | C |
| 4 | A | A | A |
| 5 | A | A | A |
| 5 (comparative) | A | D | D |
| 6 | A | A | A |

EXAMPLE 2

The following powder coating compositions were prepared:

Composition 7:

A mixture containing 100 parts of a partially saponified (saponification degree: 80%) ethylene/vinyl acetate copolymer, 50 parts of a maleimide-triazine resin, 0.3 part of an acrylic ester oligomer as a leveling agent, 0.5 part of dicumyl peroxide, 0.4 part of a blocked isocyanate and 20 parts of a polyol compound was premixed under dried state and extruded at 120° C. The extrudate was cooled to obtain pellets and the pellets were finely ground while cooling with liquid nitrogen, to obtain a powder composition. The maleimide-triazine resin (BT2170 manufactured by Mitsubishi Gas Chemicals, Inc.) is composed of 90% by weight of 2,2-bis(cyanatophenyl)propane and 10% by weight of bis(4-maleimidephenyl)methane and has a density of 1.24, a melting point of 70° C. and a grass transition point (upon curing) of 230°-250° C. The blocked isocyanate used is a compound of the formula:

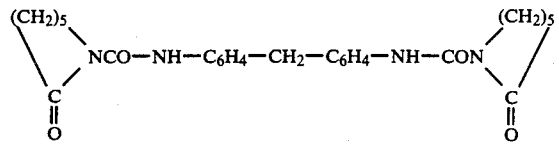

The polyol used is a wax-like substance of the formula:

$$HO-(CH_2)_5-CO-O_{17}\ R\ O-CO-(CH_2)_5]_{17}OH$$

where R is tetramethylene, and has an average molecular weight of about 4,000.

The powder composition thus obtained was then subjected to the following tests and the test results were as summarized in Table 2.

(1) Gel time:

In accordance with JIS C 2104. Test was performed at a hot plate temperature of 200° C.

(2) Horizontal melt flow:

The sample composition (1 g) was shaped into a disc having a diameter of 16 mm. The disc was placed on a flat, soft steel plate and the plate was placed in an oven maintained at 140° C. to melt the disc. The diameter (d) of the melted sample was measured. The horizontal melt flow (MF) was calculated as follows:

$$MF = \frac{d - 16}{16} \times 100\ (\%)$$

(3) Tensile strength:

The composition was subjected to powder coating to obtain a strip having a thickness of 1.0-1.5 mm, a width of 10 mm and a length of 50 mm. Tensile strength of the strip was measured in accordance with JIS K 7113-1 at room temperature and after maintained at 300° C. for 24 hours.

(4) Elongation:

Test sample was prepared in the same manner as in the above Tensile Strength Test. The elongation at the time of breakage by stretching was measured at room temperature and after maintained at 300° C. for 24 hours.

Composition 8:

The above procedure for Composition 6 was repeated in the same manner as described except that the amount of the polyol compound was increased to 40 parts. The test results are shown in Table 2.

Composition 9:

The above procedure for Composition 6 was repeated in the same manner as described except that, as the polyol compound, a compound expressed by the formula:

$$HO\ C_4H_8O\ _{40}H$$

and having an average molecular weight of about 3,000 was used. This polyol compound, too, was wax-like. The test results are shown in Table 2.

Composition 10:

The above procedure for Composition 6 was repeated in the same manner as described except that a saturated polyester resin (SP-154 manufactured by Nihon Gosei Kagaku K. K., average molecular weight: 19,000, softening point: 132, OH value (mg KOH/g): 3–7) was used in place of the partially saponified copolymer and that dicetoneacrylamide (10 parts) was used in place of the polyol compound. The test results are shown in Table 2.

Composition 11:

The above procedure for Composition 6 was repeated in the same manner as described except that a polamideamine (Tomide #1350 manufactured by Fuji Kasei K. K., average molecular weight: 10,000, softening point: 142, amine value: 2.0) was used in place of the partially saponified copolymer and that a polyethylene glycol amine (10 parts) expressed by the formula:

$$H_2NC_3H_6O\ C_2H_4O\ _nC_3H_6NH_2$$

wherein n is 88 and having an average molecular weight of 4,000 and a melting point of about 60° C. was used in place of the polyol compound. The test results are shown in Table 2.

Composition 12:

The above procedure for Composition 10 was repeated in the same manner as described except that 2,2-bis(cyanatophenyl)propane was used in place of the maleimidetriazine resin. The results are shown in Table 2.

TABLE 2

| Comp. No. | Gel time (sec) | MF (%) | Tensile strength (kg/mm2) Initial | Tensile strength (kg/mm2) After heating | Elongation (%) Initial | Elongation (%) After heating |
|---|---|---|---|---|---|---|
| 6 | 35 | 24.8 | 1.20 | 0.50 | 58.0 | 110.5 |
| 7 | 24 | 35 | 1.30 | 0.55 | 61.5 | 120.0 |
| 8 | 30 | 21.5 | 1.25 | 0.45 | 60.5 | 117.3 |
| 9 | 38 | 26 | 1.35 | 0.68 | 73 | 105.0 |
| 10 | 21 | 15.5 | 1.48 | 0.73 | 68 | 113 |
| 11 | 15 | 12.3 | 1.39 | 0.75 | 70.5 | 119 |

Composition 13:

The above procedure for Composition 8 was repeated in the same manner as described except that a copolymer obtained by grafting an unsaturated carboxylic acid (Dumilane C-2280, manufactured by Takeda Yakuhin Kogyo K. K.) to the partially saponified ethylene/vinyl acetate copolymer was used in place of the partially saponified ethylene/vinyl acetate copolymer. The powder composition was found to show satisfactory test results.

Composition 14:

The above procedure for Composition 8 was repeated in the same manner as described except that a butyral resin (Eslec BX-L, manufactured by Sekisui Kagaku Kogyo K. K.) was used in place of the partially saponified ethylene/vinyl acetate copolymer. The powder composition was found to show satisfactory test results.

Composition 15:

To 100 parts by weight of a partially saponified ethylene/vinyl acetate copolymer (saponification degree: 80%) were mixed 30 parts by weight of calcium carbonate as a filler, 5 parts by weight of azodicarbonamide as a blowing agent, a blend of another 5 parts by weight of azodicarbonamide and 3 parts by weight of zinc oxide as an expansion aid, 7.1 parts by weight (NCO/OH equivalent ratio: 0.1) of a blocked isocyanate having the formula (III) and 1.7 parts by weight of dicumylperoxide both as a cross-linking agent, and 0.5 part by weight of carbon black as a coloring agent. The thus obtained mixture was mixed in a wet state and then extruded at a temperature of 120° C. with an extruder. The extrudate was pelleticized and ground. The ground powder was then mixed in a dry state with 0.15% by weight of finely divided colloidal silica (Trademark: AEROSIL 300) as a free-flow improving agent to obtain a coating composition in the form of fine powder. This coating composition was found to give an expanded coating with an elongation of 150% at room temperature.

Composition 16:

To 100 parts by weight of a partially saponified ethylene/vinyl acetate copolymer as used in the procedure for Composition 14 were added 50 parts by weight of a polyester polyol of the formula (II) (R: pentamethylene, r: 5, q: 4), 10 parts by weight of a polytetramethylene ether glycol of the formula (I) (m: 4, n: 5), 150 parts by weight of calcium carbonate, 5 parts by weight of azodicarbonamide, a blend of another 5 parts by weight of azodicarbonamide and 2.5 parts by weight of zinc oxide, 100 parts by weight (NCO/OH equivalent ratio: 0.8) of a blocked isocyanate having the formula (III), 3.4 parts by weight of dicumylperoxide, 0.5 part by weight of dibutylene dilaurate as a curing accelerating agent and 0.5 part by weight of carbon black. The resulting mixture was extruded, pelleticized, ground and mixed with colloidal silica in the same manner as that in Composition 14 to obtain a coating composition in the form of fine powder. This coating composition was found to give an expanded coating with an elongation of 200% at room temperature.

Composition 17:

To 100 parts by weight of an ethylene/vinyl acetate copolymer (vinyl acetate content: 30 wt. %, MI: 18 g/10 minutes) were mixed 30 parts by weight of calcium carbonate as a filler, 5 parts by weight of azodicarbonamide as a blowing agent, 3 parts by weight of zinc oxide as an expansion aid, 1.7 parts by weight of dicumylperoxide as a cross-linking agent, 0.5 part by weight of carbon black as a coloring agent, and 10 parts by weight of dioctyl phthalate as a plasticizer. To this mixture was further mixed amorphous silica powder as a free-flow imparting agent in an amount of 0.15% based on the weight of said mixture. The resulting mixture was mixed and then extruded at 120° C. with an extruder. The extrudate was pelleticized and ground at −80° C. to obtain a coating composition in the form of fine powder. The coating composition had such a particle size distribution that the content of particles with a particle size of 40 mesh (Tyler) or finer was 100% by weight, the content of particles with a particle size of 200 mesh or finer was at least 50% by weight and the content of particles with a particle size of 325 mesh or finer was not greater than 50% by weight. This coating composition was found to give an expanded coating with an elongation of 250% at room temperature.

Each of the thus obtained powder coating compositions was coated over a copper pipe in the same manner as that in Example 1, followed by bending and curing (or expanding) treatments. The bent pipes were found to bear uniform coatings without surface defects.

What is claimed is:

1. A method of processing a metal body to produce a bent, metal body having a hardened resin coating on at least the bent surface, comprising the steps of:

(a) providing a powder coating composition providing a flexible, hardenable coating;

(b) coating a surface of the metal body with the powder coating composition by preheating the metal body to a temperature sufficient to melt the coating composition while preventing the coating composition from hardening, and contacting the metal body at said temperature with a fluidized mass of the powder coating composition to form a flexible, hardenable layer over the surface of the metal body;

(d) then bending the metal body at a portion having the hardenable layer; and (e) then hardening the hardenable layer.

2. A method according to claim 1, wherein said flexible, hardenable coating has an elongation of at least 40%.

3. A method according to claim 1, wherein said coating composition is expandable so that the hardenable layer is expanded during step (e).

4. The method of claim 1 wherein said hardening is effected by heating the hardenable layer to a temperature sufficient to cure the hardenable layer.

5. The method of claim 1 wherein said powder coating composition comprises a blowing agent and wherein said hardening is effected by heating the hardenable layer to a temperature sufficient to decompose said blowing agent and thereby expand the hardenable layer.

* * * * *

UNITED STATES PATENT AND TRADEMARK OFFICE

CERTIFICATE OF CORRECTION

PATENT NO. : 5,062,284

DATED : November 5, 1991

INVENTOR(S) : KUBO et al

It is certified that error appears in the above-identified patent and that said Letters Patent is hereby corrected as shown below:

Col. 5, the formula shown at lines 21-25 which reads:

"$HO-(CH_2)_r-CO]_q R\ O-CO-(CH_2)_r]_q OH$" should read:

--$HO\text{-}\!\!\vdash(CH_2)_r - CO - O\dashv_q R \vdash\!\!\text{-}O - CO - (CH_2)_r\dashv_q OH$--; and the formula shown at line 35 which reads:

"$H_2NC_3H_6O\ \ C_2H_4O\ \ {}_nC_3H_6NH_2$" should read:

--$H_2NC_3H_6O \leftarrow C_2H_4O \rightarrow {}_nC_3H_6NH_2$--.

Col. 6, line 31, " -Caprolactam" should read

-- ε-Caprolactam--.

Col. 8, line 51, " -Caprolac-" should read -- ε-Caprolac- --.

Col. 14, the formula shown at lines 25 and 26 which reads:

"$HO-(CH_2)_5-CO-O_{17}\ \ R\ \ O-CO-(CH_2)_5]_{17}OH$" should read

--$HO\text{-}\!\!\vdash(CH_2)_5 - CO - O\dashv_{17} R \vdash\!\!\text{-}O - CO - (CH_2)_5\dashv_{17} OH$".

UNITED STATES PATENT AND TRADEMARK OFFICE

CERTIFICATE OF CORRECTION

PATENT NO. : 5,062,284 Page 2 of 2

DATED : November 5, 1991

INVENTOR(S) : KUBO et al

It is certified that error appears in the above-identified patent and that said Letters Patent is hereby corrected as shown below:

Col. 15, the formula at line 3 which reads:

"$HO\ C_4H_8O\ _{40}H$" should read --$HO \leftarrow C_4H_8O \rightarrow_{40} H$--;

the formula at lines 27-30 which reads:

"$H_2NC_3H_6O\ C_2H_4O\ _nC_3H_6NH_2$" should read --$H_2NC_3H_6O\{C_2H_4O\}_nC_3H_6NH_2$ --.

Signed and Sealed this

Twenty-second Day of June, 1993

*Attest:*

*Attesting Officer*

Michael K. Kirk

MICHAEL K. KIRK

*Acting Commissioner of Patents and Trademarks*